United States Patent [19]

Asano et al.

[11] Patent Number: 4,652,158

[45] Date of Patent: Mar. 24, 1987

[54] ARMATURE SUPPORT DEVICE FOR TORSION SPRING PRINT HEAD

[75] Inventors: Kiyomitsu Asano, Tokyo; Atsuo Sakaida, Nagoya, both of Japan

[73] Assignees: Brother Kogyo Kabushiki Kaisha, Nagoya; Nippon Telecommunication Engineering Company, Tokyo, both of Japan

[21] Appl. No.: 893,460

[22] Filed: Aug. 8, 1986

Related U.S. Application Data

[63] Continuation of Ser. No. 815,680, Jan. 6, 1986, abandoned, which is a continuation of Ser. No. 615,160, May 30, 1984, abandoned.

[30] Foreign Application Priority Data

Jun. 17, 1983 [JP] Japan ..... 58-93787
Jun. 17, 1983 [JP] Japan ..... 58-93788

[51] Int. Cl.[4] ..... B41J 3/12

[52] U.S. Cl. ..... 400/124; 101/93.05; 101/93.29; 101/93.48; 335/270; 335/274

[58] Field of Search ..... 400/124, 157.1, 157.2; 101/93.05, 93.29, 93.33, 93.34, 93.48; 228/164, 165; 267/57, 57.1 A; 335/270, 274, 275, 276, 278

[56] References Cited

U.S. PATENT DOCUMENTS

| | | | |
|---|---|---|---|
| 1,293,871 | 2/1919 | Murray | 228/165 |
| 1,293,872 | 2/1919 | Murray | 228/165 |
| 1,770,852 | 7/1930 | Hill | 228/165 |
| 3,078,551 | 2/1963 | Patriarca | 228/165 |
| 3,095,644 | 7/1963 | Curry | 228/165 |
| 3,511,285 | 5/1970 | Stephens | 335/276 |
| 3,516,682 | 6/1970 | Klanner et al. | 267/57 |
| 4,167,343 | 9/1979 | Golobay | 400/124 |
| 4,351,469 | 9/1982 | Newman | 228/165 |
| 4,403,875 | 9/1983 | Asano et al. | 400/124 |

FOREIGN PATENT DOCUMENTS

| | | | |
|---|---|---|---|
| 65620 | 12/1982 | European Pat. Off. | 101/93.34 |
| 56-175 | 1/1981 | Japan | 400/124 |
| 57-203567 | 12/1982 | Japan | 400/124 |
| 58-8665 | 1/1983 | Japan | 400/124 |

*Primary Examiner*—Edgar S. Burr
*Assistant Examiner*—David A. Wiecking
*Attorney, Agent, or Firm*—Moonray Kojima

[57] ABSTRACT

An armature support pivotally supports an armature at one end thereof with the armature holding a print wire, wherein the armature support comprises a support member having a pair of arms; through holes formed in the pair of arms and having the same axis, and a penetrating hole formed in a base portion of the armature. The axis of the penetrating hole coincides with the axis of the through holes when the base portion of the armature is disposed between the pair of arms. A torsion spring member comprising a pair of larger diameter end portions, a larger diameter center portion and a pair of smaller diameter portions which interconnect the larger diameter end portions to the larger diameter center portion is disposed with the larger diameter end portions in the through holes and the larger diameter center portion being disposed in the penetrating hole, whereby the spring member is connected to the support member and armature at the larger diameter end and center portions. Soldering holes are provided all on the same side of the print armature assembly to solder the torsion spring to the support arms and armature.

8 Claims, 8 Drawing Figures

ARMATURE SUPPORT DEVICE FOR TORSION SPRING PRINT HEAD

This application is a continuation of Ser. No. 815,680 filed Jan. 6, 1986, now abandoned, which was a continuation of Ser. No. 615,160 filed May 30, 1984, also abandoned.

BACKGROUND OF THE INVENTION

1. Field of the Invention

This invention relates to a print head, such as used in a dot matrix printer, and more particularly to armature support devices used therewith.

2. Description of the Prior Art

Print heads, such as used in dot matrix printers, ideally are capable of high speed printing, are durable, and do not require much maintenance. Print heads, such as disclosed in U.S. Pat. Nos. 4,136,978; 4,403,875 and 4,167,343, were proposed as improvements. The print heads disclosed in U.S. Pat. Nos. 4,136,978 and 4,403,875, are disadvantageous because of the large number of parts which are used, their complicated structures, and complex assembling procedures required to construct such heads. Moreover, from the viewpoint of high speed printing, these printing heads are disadvantageous because of the use of a large amount of mass in their moving parts. Accordingly, these prior print heads are not entirely suitable. The print head disclosed in U.S. Pat. No. 4,167,343 has a problem in that the torsion rod member, armature assembly and support arm are mutually constructed. This construction is deficient from the viewpoint of practicality because of the transmission of torsional forces from the torsion rod member to the other members, and because no consideration was given to use of a comparatively small force to supply the torsion rod member with torsion energy.

SUMMARY OF THE INVENTION

Accordingly, an object of the invention is to overcome the aforementioned and other disadvantages and deficiencies of the prior art.

Another object is to provide a print head which is excellent in durability and reliability and which has an armature support mechanism which is capable of responding at high speeds.

A further object is to provide a print head which has an armature with substantially reduced mass, and which is capable of high speed operation.

The foregoing and other objects are attained by the invention which encompasses an armature support device for a print head, comprising a support member having a pair of arms; through holes formed in the pair of arms and having the same axis; a penetrating hole formed in a base portion of the armature, with the axis of the penetrating hole coinciding with the axis of the through holes when the base portion of the armature is disposed between the pair of arms; and a spring member including two large diameter end portions, a large diameter center portion and a pair of smaller diameter portions interconnecting the end and center portions, with the large diameter end portions being disposed in the through holes and the large diameter center portion being disposed in the penetrating hole, and further with the spring member being connected to the support member and the armature at the large diameter portions.

DETAILED DESCRIPTION OF PREFERRED EMBODIMENTS

Figure 1:
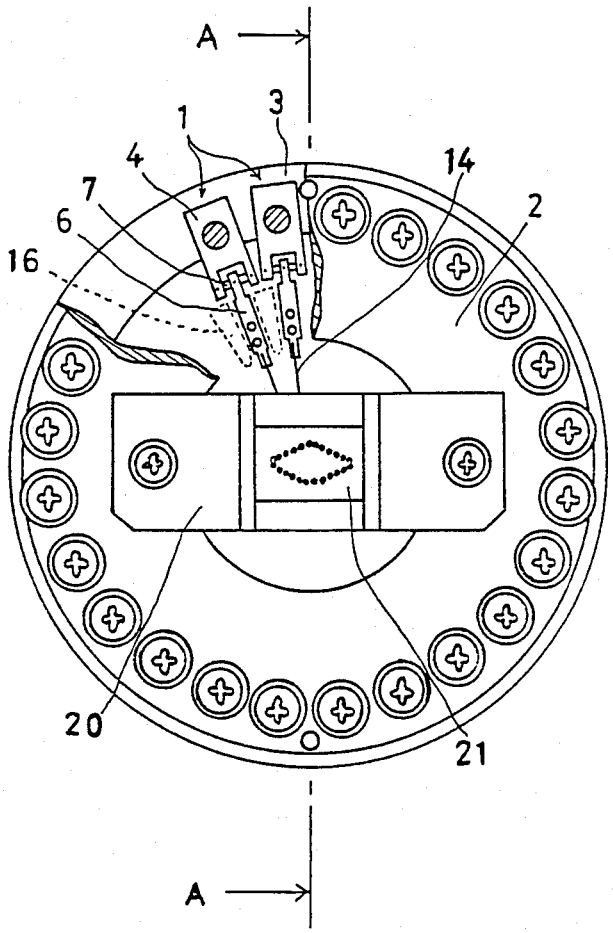
FIG. 1 is a plan view, partly in section, depicting an illustrative embodiment of the invention.
Figure 2:
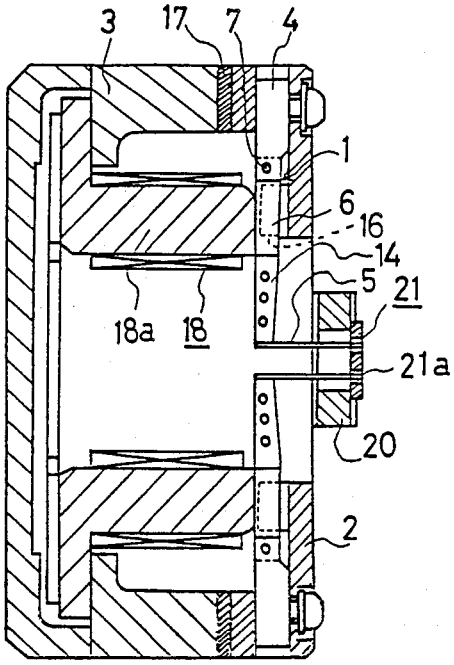
FIG. 2 is a sectional view taken along line A—A in FIG. 1.

Turning now to FIG. 1, there is depicted a print head apparatus wherein a plurality of working members 1 are disposed between a front yoke 2 and a rear frame 3, and arranged in radial directions on a circumference and spaced from each other by predetermined intervals, and fixed, for example, by screws. Each working member 1 comprises a holder 4 fixed with a screw between front yoke 2 and frame 3, an armature 6, with a top end having a printing wire 5 (see FIG. 2), and a torsion spring 7 disposed between holder 4 and armature 6.

Figure 3:
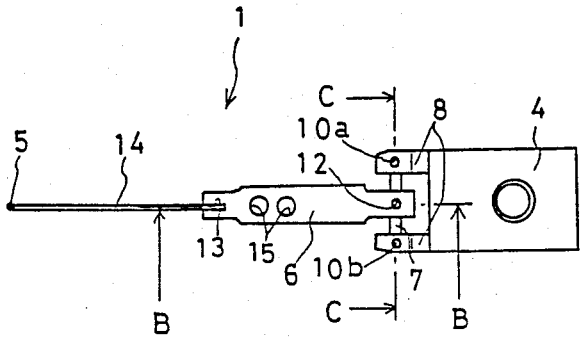
FIG. 3 is an enlarged front view of a working member.

A pair of arms 8 (FIG. 3) are formed on a top end of holder 4. Through holes *9a,9b* (FIG. 6) to support torsion spring 7, at both ends in the axial direction, are bored in arms 8, respectively. Arms 8 have solder holding holes *10a,10b* which lead to through holes *9a,9b*, respectively, and serve to hold solder material to be used during brazing procedure, and are formed in a perpendicular direction to the axis of the torsion spring 7.

Figure 5:
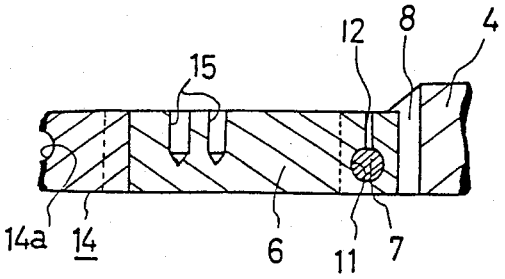
FIG. 5 is an enlarged sectional view taken along line B—B in FIG. 3.

Armature 6 is made, for example, of permendur, which is a Co-Fe alloy having high magnetic flux density. One end of armature 6 is disposed between arms 8,8 and a through hole, also called penetrating hole, 11 (FIG. 5) is bored therein for inserting the center portion of spring 7. The bottom end of armature 6 has a solder holding hole 12 (FIG. 3) which leads to through hole 11 (FIGS. 3 and 5) and serves to hold solder material which is used during brazing of torsion spring 7 to armature 6. The hole 12 is formed in a perpendicular direction to the axis of spring 7. The top end of armature 6 has a recess 13 (FIG. 3) for brazing of wire holder 14, to which the base end of print wire 5 is brazed. An opening 15 for reducing the mass of armature 6, is formed toward the top end of armature 6.

Figure 4:
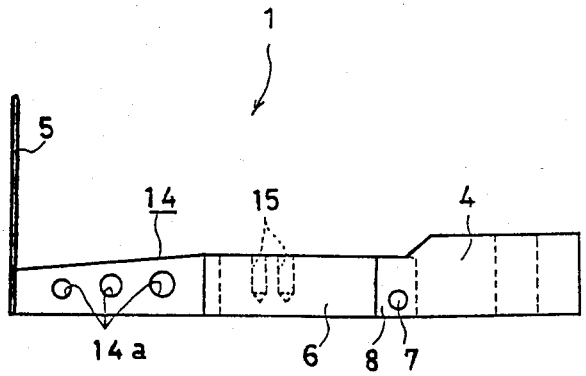
FIG. 4 is a side view of FIG. 3.

A guide member 21 (FIGS. 1 and 2) for guiding the top end of print wire 5, is supported by frame 20, which is fixed to front yoke 2. A plurality of guide holes *21a* (FIG. 2) are arranged in rhombic form on guide member 21, and the top end of each print wire 5 is inserted linearly in a corresponding one of guide holes *21a*. Wire holder 14 (FIG. 4) has holes *14a* are bored therein so as to reduce the mass thereof.

Torsion spring 7 is made, for example, of mar-aging steel which is a high nickel steel of very low carbon content. Spring 7 has a larger diameter end portions *7a* and *7c* (FIG. 6) disposed within through holes *9a,9b*, respectively, and larger diameter center portion *7b* disposed within penetrating hole 11, so as to reduce torsional stress acting on holder 4 and brazed portion of armature 6. Larger end portions 7a,7c are interconnected to larger center portion 7b, by smaller diameter portions 7d. Torsion spring 7 is subjected to solid solution treatment and aging treatment during the process of brazing of holder 4 with armature 6 and spring 7, as hereinafter described.

Referring again to FIG. 1, front yoke 2 has a plurality of projections 16, in integral construction, which project between adjacent armatures 6 and form a part of the magnetic circuit from front yoke 2 to the lateral surface of armature 6 during energization of solenoid 18, as hereinafter discussed.

On rear frame 3 is secured a permanent magnet 17 (FIG. 2) which rotates armature 6 towards core 18a, against the spring force of spring 7, during a non-driving state of solenoid 18.

A plurality of solenoids 18 are arranged within rear frame 3 corresponding to respective armatures 6. When solenoid 18 is driven, according to a print signal, solenoid 18 cancels the magnetic force of permanent magnet 17. Thus, armature 6, corresponding to solenoid 18, is driven by means of spring force of torsion spring 7, and print wire 5, fixed to armature 6, performs printing operation.

Figure 6:
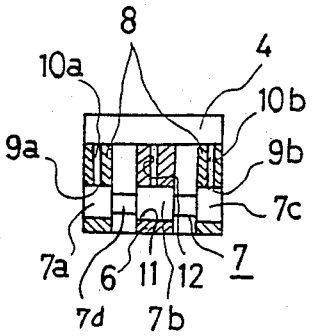
FIG. 6 is an enlarged sectional view taken along line C—C in FIG. 3.

The connecting of holder 4 with armature 6 and spring 7 will now be described with reference to FIG. 6. The larger diameter end portions 7a,7c are inserted in through holes 9a, 9b, and larger diameter center portion 7b is inserted in penetrating hole 11, as shown in FIG. 6, and holder 4 is assembled with armature 6 and torsion spring 7, temporarily, and then palladium solder, as a solder material, in pellet or rod form, is inserted into solder holding holes 10a,10b and 12. Other solders such as silver solder may be used.

A brazing jig (not shown) holds the assembly of holder 4, armature 6 and torsion spring 7, temporarily, and the jig and assembly held therein are set in a vacuum heating furnace, and subjected to vacuum heating treatment, under heating conditions of heating temperature of about 950° C. and a heating period of about 20 minutes. The palladium solder, held in holes 10a,10b-,and 12, is melted by the vaccum heat treatment. At the same time, the solder fills in the gap between holder 4 and larger diameter portions 7a,7c via holes 10a, and 10b; and fills in the gap between armature 6 and larger diameter portion 7b via hole 12, by means of capillary action. Torsion spring 7 is treated in a solid solution by vacuum heat treatment thereby to remove internal stresses therein.

After vacuum heat treatment, a cooling gas, such as nitrogen gas, is introduced whereby holder 4, armature 6 and spring 7 are rapidly cooled to about 500° C. and the palladium solder is hardened. The above state is held for about one hour whereby torsion spring 7 is subjected to an aging treatment. The aging treatment increases the strength and hardness of the spring 7.

According to the above process, holder 4 is connected by brazing to armature 6 and torsion spring 7, thereby to form a working member 1.

Operation of the illustrative embodiment will now be described with reference to FIGS. 7 and 8. When solenoid 18 is not driven, armature 6 is rotated toward core 18a, perpendicular to the axis of spring 7, against the spring force of spring 7, by means of the magnetic force of permanent magnet 17. Thus, torsion energy is stored in the smaller diameter portion 7d of torsion spring 7.

Figure 7:
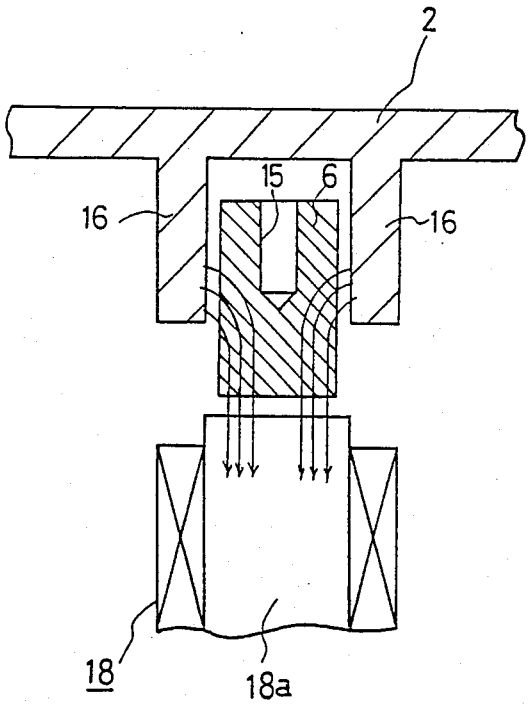
FIG. 7 is a detailed view depicting a magnetic circuit.
Figure 8:
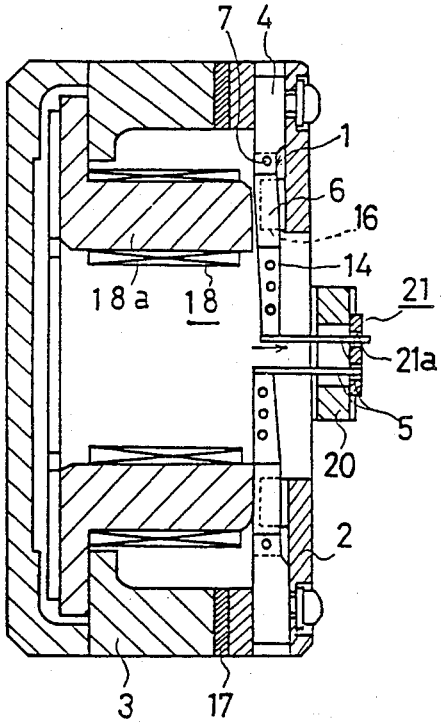
FIG. 8 is a sectional view depicting an operational state of the print head.

When solenoid 18 is driven, based on printing signal, the magnetic circuit of solenoid 18 comprises front yoke 2, projection 16 and armature 6, as shown in FIG. 7. Since the magnetic force of permanent magnet 17 is cancelled by the magnetic force of solenoid 18, armature 6 corresponding to the solenoid, is released from the magnetic force of permanent magnet 17. In this state, armature 6 is rotated in the direction of the arrow, shown in FIG. 8, based on energy stored in the torsion spring 7, and print wire 5, fixed to armature 6, performs printing operation, whereby a character is printed in dot matrix form. Since the top end of armature 6 has opening 15 formed at a part thereof which is not needed for the magnetic circuit, the mass of the armature 6 can be substantially reduced without increasing magnetic reluctance, and armature 6 can be readily rotated at high speeds.

On the other hand, when armature 6 is rotated, torsional stress of spring 7, acts on portions of holder 4 brazed to armature 6 and spring 7. The torsional stress $\tau$ is generally represented by the formula:

ti $\tau_{max}=16T/\pi d^3$ wherein $T=WL$, W being a couple acting on the torsion spring 7; L being length, and d being diameter. If couple W and length L are made constant, torsional stress $\tau$ is determined by the diameter d of the torsion spring 7. Since the torsion spring 7 is brazed at the larger diameter portions 7a,7b, and 7c, the torsional stress acting on the brazed portion is reduced.

According to this embodiment, torsional stress action on the portion of holder 4 brazed to armature 6 and torsion spring 7, can be reduced and the brazed portion can be prevented from breaking.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. An armature support device of a print head, said support device pivotally supporting an armature at one end thereof, a print wire held at another end thereof, said armature having a base portion adjacent said one end; said support device comprising a support member having a pair of arms;

a circular through hole formed in each arm of said pair of arms, said through holes positioned to have the same axis;

a penetrating hole formed in said base portion of said armature and having an axis coinciding with said axis of said through holes when said base portion is disposed between said pair of arms; and a circular cylindrical torsion spring member comprising a pair of end portions, a center portion and a pair of connecting portions for interconnecting said end portions to said center portion, with said end portions being disposed in said through holes and said center portion being disposed in said penetrating hole, wherein said end portions have predetermined diameters, said center portion has a selected diameter, and said connection portions have diameters smaller than said predetermined diameters and smaller than said selected diameter, wherein said spring member is connected with said support member and said armature at said end portions and at said center portion, wherein said end portions are brazed to said pair of arms and said center portion is brazed to said base portion, wherein said spring member normally retains said armature at a predetermined position, and when said armature is pivoted away from said predetermined position, said center portion is pivoted together with said armature, whereby said connecting portions are twisted to produce a torsional force acting to restore said armature to said predetermined position, and wherein said armature further comprises a second hole having an axis approximately perpendicular to the axis of said penetrating hole and leading to said penetrating hole from a surface of said armature, and wherein each arm of said pair of arms further comprises a third hole having an axis approximately perpendicular to said axis of said circular through hole and leading to said circular through hole from a surface of said each arm positioned on the on the same side as said surface of said armature, said second and third holes are initially filled with a brazing material, said brazing material forming said brazing between said armature and said center portion of said spring, and between said pair of arms and said pair of end portions of said spring.

2. The device of claim 1, wherein said brazing material is silver solder.

3. The device of claim 2, wherein said armature is made of permendur alloy of cobalt and iron.

4. The device of claim 2, wherein said spring member is made of mar-aging steel.

5. The device of claim 1, wherein said armature is provided with an opening so as to reduce the mass of said armature.

6. A print head, including a support member disposed between a front yoke and a rear frame;

a plurality of armatures, each having a base portion at one thereof;

said rear frame having a plurality of solenoids disposed so as to face each of said plurality of armatures;

a permanent magnet disposed on said rear frame;

a print wire secured to another end of each of said armatures; and a spring member pivotally connecting said one end of each armature to said support member;

wherein said print head further comprises said support member having a plurality of pairs of arms;

a circular through hole formed in each arm of said pair of arms, each said through holes in each of said pair of arms being positioned to have the same axis;

a penetrating hole formed in said base portion of each armature, and having an axis coinciding with said axis of said through holes when said base portion is disposed between said pair of arms, each spring member comprising a pair of end portions, a center portion, and a pair of connecting portions connecting said end portions to said center portion, said end portions being disposed within said through holes and said center portion being disposed within said penetrating hole, wherein said end portions have a predetermined diameter, said center portion has a selected diameter and said connection portions have a diameter smaller than said predetermined diameter and smaller than said selected diameter, and wherein each said spring member is connected to each said support member and each said armature at said end portions and at said center portion, wherein said end portions are brazed to said arms and said center portion is brazed to said base portion, wherein each said armature is normally retained at a predetermined position by magnetic force of said permanent magnet with said center portion of each said spring member being twisted to cause torsion strain, each said armature being pivoted from said predetermined position to an operating position by a torsional force produced by said torsion strains when said solenoid is energized to thereby neutralize the magnetic force caused by said permanent magnet, wherein said armature is provided with a second hole having having an axis perpendicular to said axis of said penetrating hole and leading to said penetrating hole from a surface of said armature, and wherein each arm of said pair of arms is provided with a third hole having an axis perpendicular to said axis of said circular through hole and leading to said circular through hole from a surface of said each arm positioned on the same side as said surface of said armature, said second and third holes initially filled with a brazing material forming the brazing between said armature and said center portion of said spring, and between said pair of arms and said pair of end portions of said spring.

7. The print head of claim 6, wherein each said armature is made of permendur alloy of cobalt and iron, and each said spring member is made of mar-aging steel.

8. The print head of claim 6, wherein said front yoke has a plurality of projections projected between adjacent said armatures, and said armature is provided with an hole, and said hole has an axis perpendicular to said axis of said penetrating hole and is formed in a surface of said armature opposed with the other surface thereof opposite to said solenoid, so as to form a part of the magnetic circuit, which enters from projections of said front yoke to the lateral surface of said armature and reaches to said solenoid without crossing the hole.

* * * * *